US011540650B2

(12) United States Patent
McAndrew et al.

(10) Patent No.: US 11,540,650 B2
(45) Date of Patent: Jan. 3, 2023

(54) AIR GUIDING STRIP FOR REFRIGERATORS

(71) Applicant: Aerofoil Energy Ltd, Bollington (GB)

(72) Inventors: Paul Francis McAndrew, Poynton (GB); Matthew Piers Burke, Newbury (GB); Ian Stuart Turner, Oxford (GB)

(73) Assignee: Aerofoil Energy Limited, Cheshire (GB)

( * ) Notice: Subject to any disclaimer, the term of this patent is extended or adjusted under 35 U.S.C. 154(b) by 25 days.

(21) Appl. No.: 17/222,629

(22) Filed: Apr. 5, 2021

(65) Prior Publication Data

US 2021/0393052 A1 Dec. 23, 2021

Related U.S. Application Data

(63) Continuation of application No. 15/778,973, filed as application No. PCT/GB2016/053698 on Nov. 24, 2016, now Pat. No. 10,966,547.

(30) Foreign Application Priority Data

Nov. 25, 2015 (GB) ..... 1520795

(51) Int. Cl.

| | |
|---|---|
| ***A47F 3/04*** | (2006.01) |
| ***F25D 23/02*** | (2006.01) |
| ***F25D 25/02*** | (2006.01) |

(52) U.S. Cl.

CPC ..... *A47F 3/0447* (2013.01); *A47F 3/0469* (2013.01); *F25D 23/023* (2013.01); *F25D 25/02* (2013.01); *F25D 2317/063* (2013.01)

(58) Field of Classification Search

CPC ..... A47F 3/0447; A47F 3/0469; F25D 17/06; F25D 23/023; F25D 25/02; F25D 2317/063

See application file for complete search history.

(56) References Cited

U.S. PATENT DOCUMENTS

2016/0302591 A1* 10/2016 McAndrew ..... F25D 23/023

FOREIGN PATENT DOCUMENTS

JP 2011131036 A * 7/2011
WO WO-2014167320 A1 * 10/2014 ..... A47F 3/0447

* cited by examiner

*Primary Examiner* — Joseph F Trpisovsky

(57) ABSTRACT

A refrigerator has an open front, an air curtain system having at least one upper air egress having an outer edge and at least one lower air-recovery ingress. The air curtain system is adapted to produce a substantially vertical air curtain over at least part of the open front of the refrigerator. The refrigerator has a plurality of shelves between the egress and the ingress a plurality of shelves between the egress and the ingress including a first shelf that has an aerofoil positioned in front of it, the first shelf being located in the upper half of the open front of refrigerator. The refrigerator also includes a second shelf that does not have an aerofoil positioned in front of it, the second shelf being located below the first shelf.

20 Claims, 9 Drawing Sheets

AIR GUIDING STRIP FOR REFRIGERATORS

CROSS-REFERENCE TO RELATED APPLICATIONS

This application is a continuation of U.S. application Ser. No. 15/778,973, now U.S. Pat. No. 10,966,547, a U.S. National Phase under 35 U.S.C. 371 of International Patent Application No. PCT/GB2016/053698, entitled "Improvements In Refrigerators", filed on Nov. 24, 2016, which claims priority to G.B. Application No. 1520795.4, entitled "Improvements In Refrigerators", and filed on Nov. 25, 2015, the entire contents of each of which are hereby incorporated by reference in their entirety.

FIELD

The present invention relates to improvements in refrigerators.

In particular the present invention relates to improvements in the stabilization of air curtains on open-fronted refrigerators using aerofoils.

BACKGROUND

The use of aerofoils to stabilise air curtains on open-fronted refrigerators using aerofoils was first proposed in International patent application no. PCT/GB2014/051102.

In that patent document it is described how aerofoils positioned in front of each shelf of the refrigerator may stabilise the air curtain and thereby lower the cost of running the refrigerator and lead to an energy saving.

However, the attaching of aerofoils to shelves can be problematic in a retail environment in that they can block the view that shoppers have of display products.

SUMMARY

The present invention seeks to address this issue.

According to a first aspect of the present invention there is provided a refrigerator having an open front, the refrigerator comprising: an air curtain system having at least one upper air egress and at least one lower air-recovery ingress, the air curtain system being adapted to produce a substantially vertical air curtain over at least part of the open front of the refrigerator; a plurality of shelves between the egress and the ingress including: a first shelf that has an aerofoil positioned in front of it, the first shelf being located in the upper half of the open front of refrigerator; a second shelf that does not have an aerofoil positioned in front of it, the second shelf being located below the first shelf.

Provision of an aerofoil in the upper half of a refrigerator and above at least one shelf that does not have an aerofoil provides significant advantages.

Provision of an aerofoil in the upper half of the refrigerator provides an energy saving that is greater than the energy saving that might be expected. The energy saving provided is disproportionate in comparison to an average energy saving per aerofoil when aerofoils are fitted to all shelves of the refrigerator.

By leaving at least one shelf without an aerofoil consumers may more readily view and access products stored in the refrigerator.

In some embodiments the first shelf is located in the upper third of the open front of the refrigerator.

In some embodiments the first shelf is located in the upper quarter of the open front of the refrigerator.

In some embodiments the first shelf is located in the upper fifth of the open front of the refrigerator.

In some embodiments the first shelf is the uppermost shelf of the refrigerator.

In some embodiments the first shelf is the second shelf down from the top of the refrigerator.

In some embodiments a plurality of shelves have respective aerofoils positioned in front of them and the location of shelves with aerofoils is biased towards the upper air egress.

In some embodiments a plurality of shelves located below the first shelf do not have aerofoils positioned in front of them.

In some embodiments a refrigerator has x shelves and x-1 shelves have aerofoils in front of them.

In some embodiments a refrigerator has x shelves and x-2 shelves have respective aerofoils in front of them.

In some embodiments a refrigerator has x shelves and x-3 shelves have respective aerofoils in front of them.

In some embodiments a refrigerator has x shelves and x-4 shelves have respective aerofoils in front of them.

In some embodiments a refrigerator has x shelves and x-5 shelves have respective aerofoils in front of them.

In some embodiments a refrigerator has x shelves and x-6 shelves have respective aerofoils in front of them.

In some embodiments a refrigerator has 7 shelves.

In some embodiments a refrigerator has 6 shelves.

In some embodiments a refrigerator has 5 shelves.

In some embodiments a refrigerator has 4 shelves.

In some embodiments a refrigerator has 3 shelves.

In some embodiments only one shelf adjacent the upper air egress has an aerofoil positioned in front of it.

In some embodiments only two shelves adjacent the upper air egress have respective aerofoils positioned in front of them, as shown, for example, in FIG. 3A.

In some embodiments only three shelves adjacent the upper air egress have respective aerofoils positioned in front of them, as shown, for example, in FIG. 3B.

In some embodiments an aerofoil is positioned only in front of the second shelf down from the top of the refrigerator, as shown for example, in FIG. 3C.

In some embodiments aerofoils are positioned only in front of the second and third shelves down from the top of the refrigerator, as shown for example in FIG. 3D.

In some embodiments the lowest shelf in the refrigerator does not have an aerofoil positioned in front of it.

In some embodiments the two lowest shelves in the refrigerator do not have aerofoils positioned in front of them.

In some embodiments the three lowest shelves in the refrigerator do not have aerofoils positioned in front of them.

In accordance with a second aspect of the present invention there is provided a method of refrigeration comprising the steps of: providing a refrigerator constructed in accordance with any preceding statement of invention; positioning a plurality of comestible items in the refrigerator; and operating the refrigerator.

In some embodiments the refrigerator is operated in a retail environment.

According to a third aspect of the present invention there is provided the use of an aerofoil in front of a shelf in the upper half of a refrigerator to effect an energy saving that is greater than the average energy saving per aerofoil when aerofoils are fitted to all shelves of the refrigerator.

BRIEF DESCRIPTION OF THE FIGURES

In order that the present invention may be more fully understood a specific embodiment will now be described by way of example with reference to the accompanying drawings, of which:

Referring to the drawings, FIG. 1 shows a standard open-fronted refrigerator 1 having an open front 2 and a plurality of shelves 3. Refrigerator 1 comprises an air curtain system having an air egress 4 at its top and located above the open front of the refrigerator and an air recovery ingress 5 located below egress 4.

Various other elements of the air curtain system exist, but such systems are so well-known in the art that further discussion thereof is not considered necessary.

The air curtain system of refrigerator 1 is adapted to pass an air curtain of cooled air between air egress 4 and air recovery ingress 5 such that the air curtain passes in front of shelves 3*a*, 3*b*, 3*c*, 3*d*, 3*e* so as to increase the efficiency of refrigerator 1.

Air egress 4 has an outer edge 6, and an air curtain expelled from air egress 4 therefore directly after expulsion from air egress 4 has its front edge substantially in line with outer edge 6.

Figure 1:
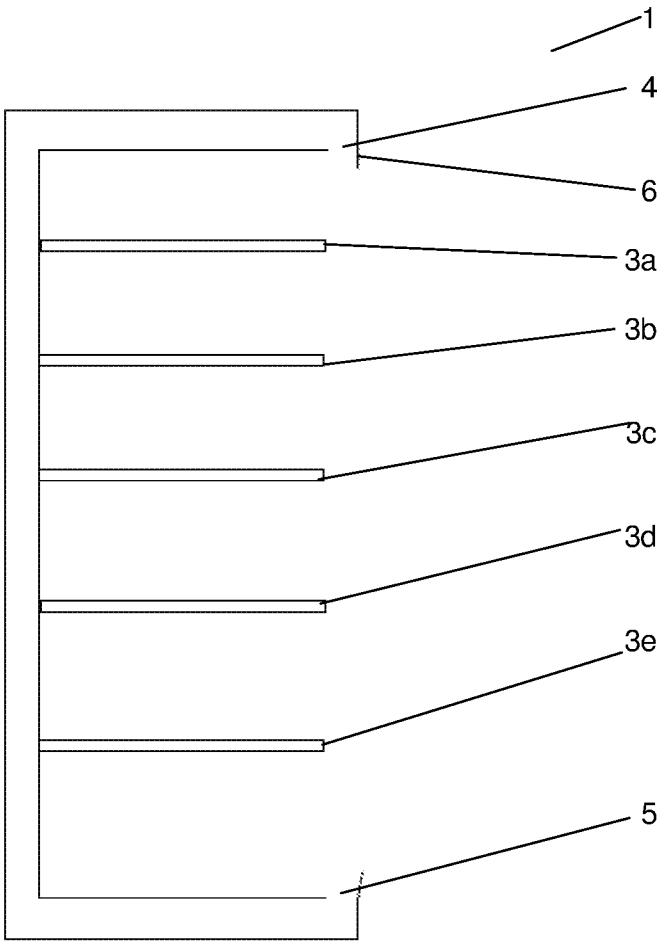
FIG. 1 is a schematic cross-section of a standard prior-art open-fronted refrigeration unit.
Figure 2:
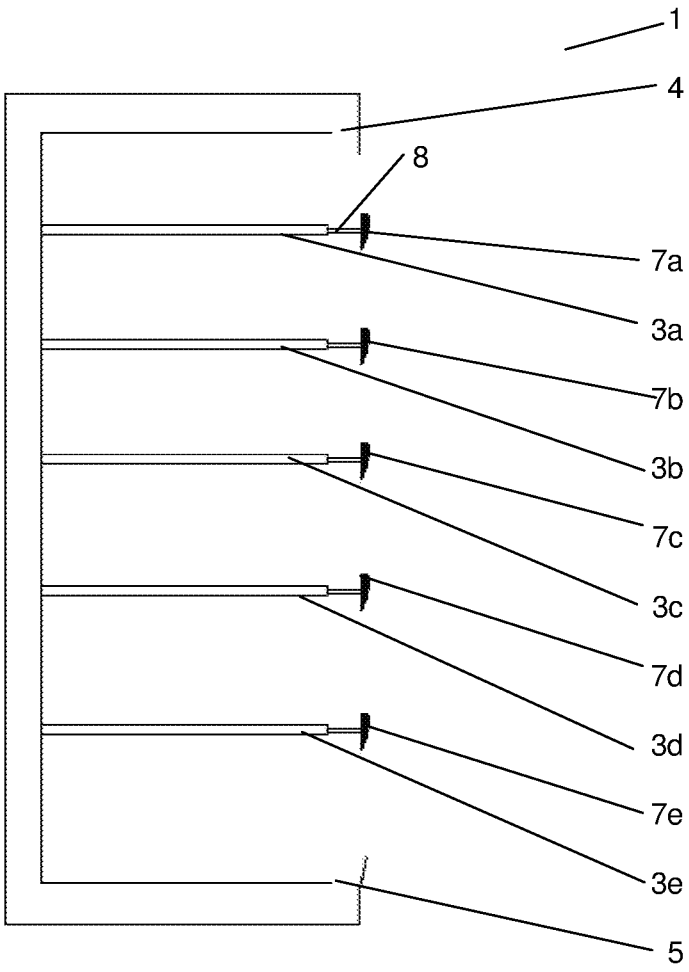
Figure 2 Prior Art
FIG. 2 is a schematic cross-section of a prior-art open-fronted refrigeration unit fitted with aerofoils.

Referring to FIG. 2 wherein the refrigerator of FIG. 1 has been fitted with a aerofoils in accordance with the prior art invention of PCT/GB2014/051102, each shelf 3*a*, 3*b*, 3*c*, 3*d*, 3*e* has had attached thereto a respective aerofoil 7*a*, 7*b*, 7*c*, 7*d*, 7*e*, which is attached to its respective shelf 3*a*, 3*b*, 3*c*, 3*d*, 3*e* by means of brackets 8 (only one of which is labeled in FIG. 2 for clarity) such that aerofoils 7*a*, 7*b*, 7*c*, 7*d*, 7*e* are each substantially vertically beneath outer edge 6 of air egress 4.

Figure 5:
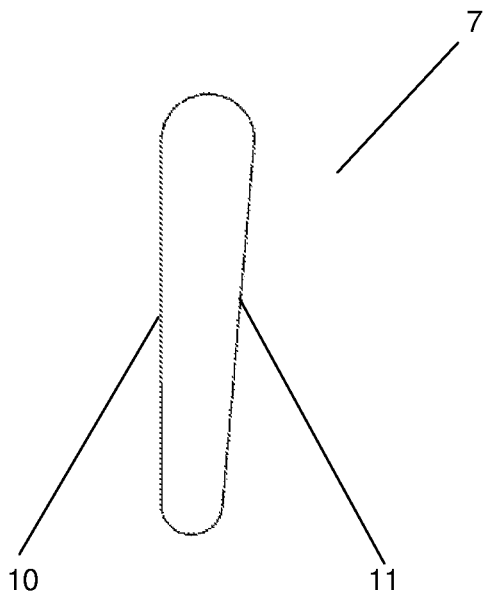
FIG. 5 is schematic cross-section of an aerofoil used with the present invention.

Referring to FIG. 5, aerofoils 7 each have a lower surface 10 (also known as a 'pressure surface') which faces front edge of shelves 3*a*, 3*b*, 3*c*, 3*d*, 3*e* and an upper surface 11 (also known as a 'suction surface') which faces outwardly from the storage space of the refrigerator such that when refrigerator is in use upper surface 11 faces a user.

As illustrated in FIG. 2 prior art refrigerators 1 comprise an aerofoil 7*a*, 7*b*, 7*c*, 7*d*, 7*e* in front of each shelf 3*a*, 3*b*, 3*c*, 3*d*, 3*e*.

It has, however, been surprisingly found that significant energy savings may be derived from attaching aerofoils to only a selection of shelves.

In particular it has been found that by attaching aerofoils to shelves in the upper half of the refrigerator, that is to say locating shelves with aerofoils adjacent or near air egress 4, the majority of the energy savings available may be achieved.

A five-shelf refrigerator was tested in an EN23953 standard test chamber.

A first test was conducted using five aerofoils such that an aerofoil was fitted to each shelf as illustrated in FIG. 2.

The result was a 25.83% energy saving compared to the refrigerator operating with no aerofoils.

Figure 3A:
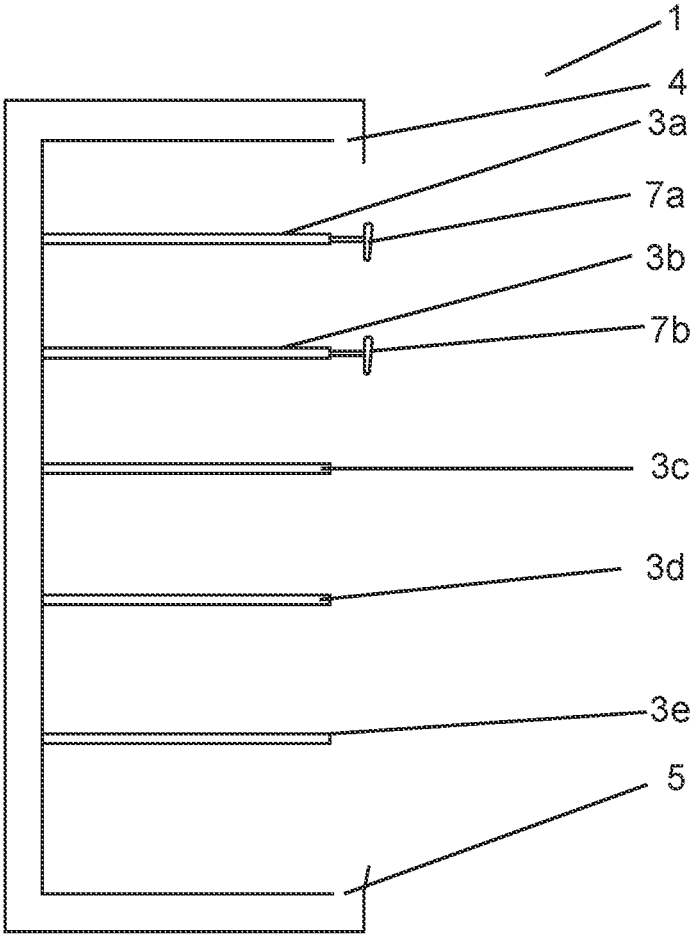
FIG. 3A is a schematic cross-section of a refrigeration unit made in accordance with a first embodiment of the present invention.
Figure 3B:
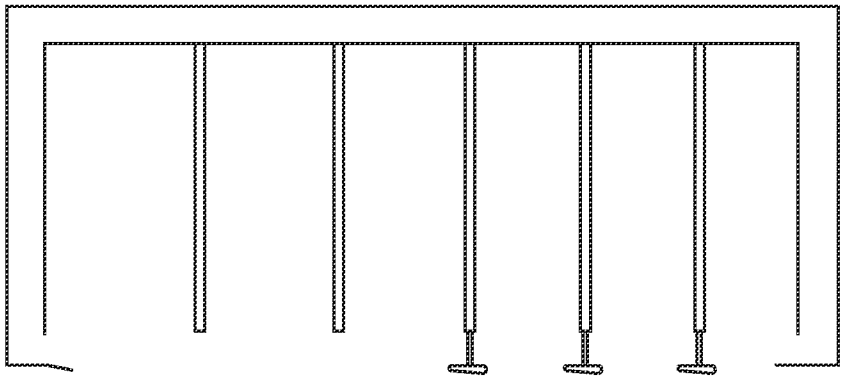
FIG. 3B is a schematic cross-section of a refrigeration unit made in accordance with a second embodiment of the present invention.
Figure 3C:
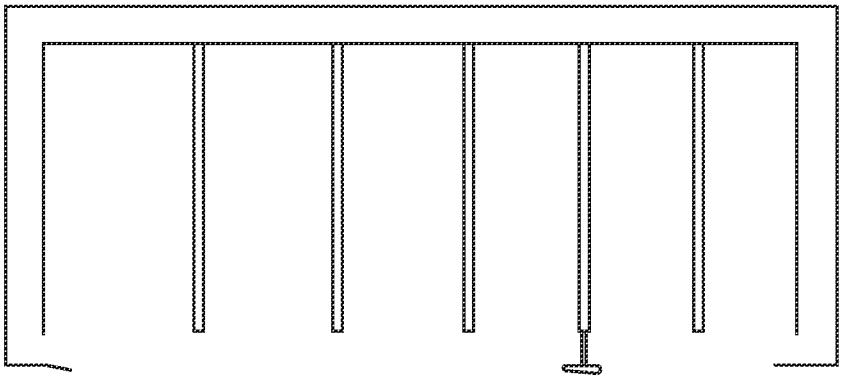
FIG. 3C is a schematic cross-section of a refrigeration unit made in accordance with a third embodiment of the present invention.
Figure 3D:
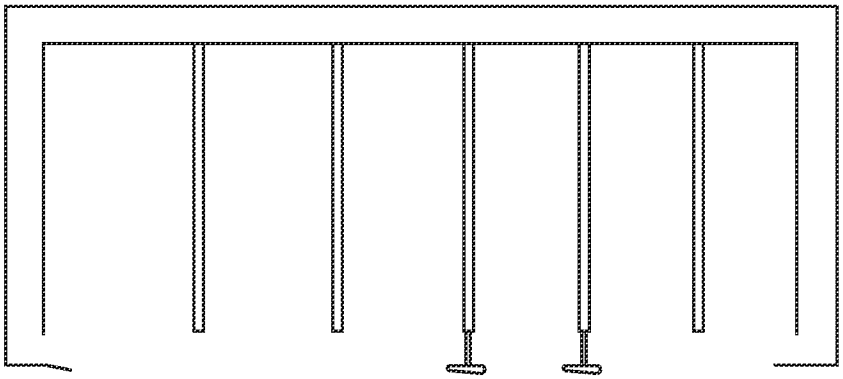
FIG. 3D is a schematic cross-section of a refrigeration unit made in accordance with a fourth embodiment of the present invention.

A second test was conducted using two aerofoils as illustrated in FIG. 3A. As can be seen, refrigerator 1 comprises two aerofoils 7*a*, 7*b* attached to only the top two shelves 3*a*, 3*b*, of refrigerator 1, i.e. those shelves adjacent air egress 4. The result was an 18.41% energy saving compared to the refrigerator operating with no aerofoils.

Figure 4:
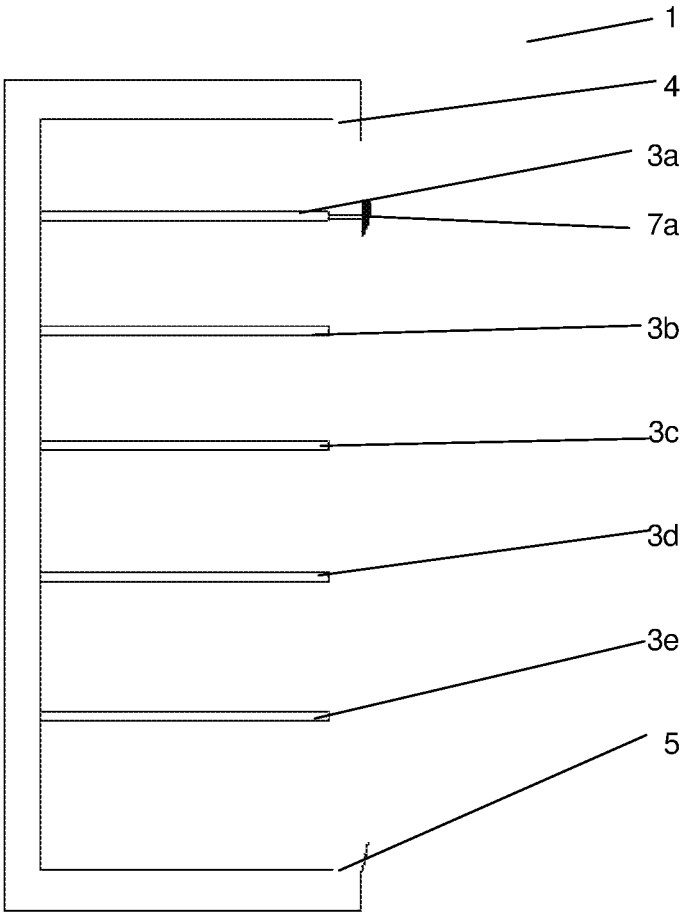
FIG. 4 is a schematic cross-section of a refrigeration unit made in accordance with a fifth embodiment of the present invention.

A third test was conducted using a single aerofoil attached to the top shelf as illustrated in FIG. 4. As can be seen, refrigerator 1 comprises a single aerofoil 7*a* attached to the top shelf 3*a*, of refrigerator 1, i.e. the shelf adjacent air egress 4. The result was a 12.48% energy saving compared to the refrigerator operating with no aerofoils.

Figure 6:
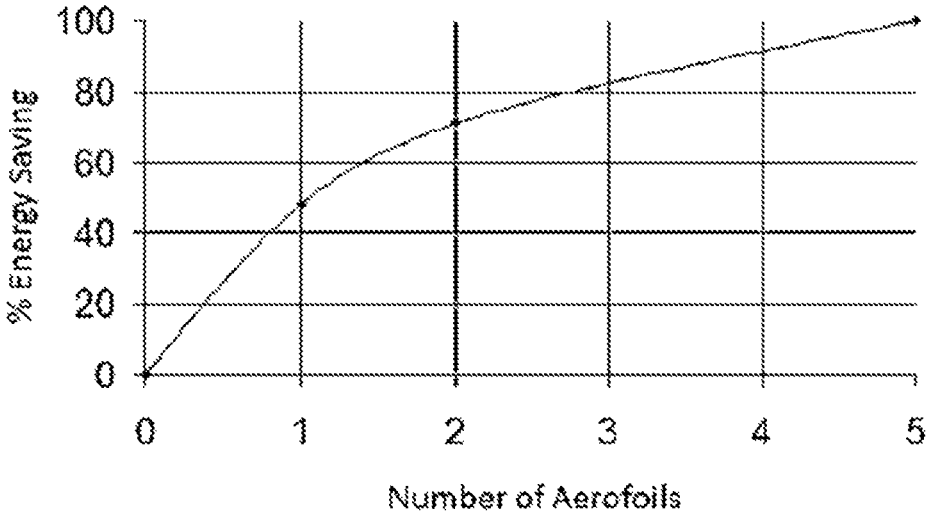
FIG. 6 is a chart showing experimental data illustrating energy saving as a function of number of aerofoils.

FIG. 6 plots these results.

Thus it can be seen that nearly 50% of the energy savings obtained by five aerofoils may be obtained by fitting only a single aerofoil to the shelf adjacent the air egress of a refrigerator.

As such the fitting of an aerofoil to a shelf in the upper half of a refrigerator appears to provide a disproportionate energy saving in comparison to an average energy saving per aerofoil when aerofoils are fitted to all shelves of a refrigerator.

This is particularly beneficial as it means that significant energy savings may be obtained even when one or more lower shelves do not have aerofoils attached to them. This therefore largely surmounts the problem of aerofoils blocking or hindering the view of products by shoppers in a retail environment.

Further, by not fitting aerofoils to all shelves of a refrigerator the both cost of improving the efficiency of a refrigerator and the materials required to improve the efficiency of a refrigerator are reduced.

Typically open-fronted refrigerators in retail environments comprise between 3 and 7 shelves.

Experimentation in relation to the energy-savings provided by different arrangements of aerofoils is still being undertaken.

However, various arrangements of aerofoils are anticipated to provide energy savings, and these 'types' are set out in the following tables.

In these tables under the heading 'shelf', number 1 refers to the uppermost shelves and subsequent numbers refer to shelves below, such that, for example shelf number 3 in the 3-shelf refrigerator is the lowest shelf.

The letter 'T' is an abbreviation for the word 'Type'.

The letter 'A' indicates that an aerofoil is attached to the shelf and the letter 'X' indicates that no aerofoil is present on the shelf.

| 3-Shelf Refrigerator | | |
|---|---|---|
| Shelf | T 1 | T2 |
| 1 | A | A |
| 2 | A | X |
| 3 | X | X |

4-Shelf Refrigerator

| Shelf | T 1 | T2 | T3 | T4 | T5 |
|---|---|---|---|---|---|
| 1 | A | A | A | X | A |
| 2 | A | A | X | A | X |
| 3 | A | X | X | X | A |
| 4 | X | X | X | X | X |

5-Shelf Refrigerator

| Shelf | T1 | T2 | T3 | T4 | T5 | T6 |
|---|---|---|---|---|---|---|
| 1 | A | A | A | X | X | A |
| 2 | A | A | X | A | A | X |
| 3 | A | X | X | X | A | A |
| 4 | X | X | X | X | X | X |
| 5 | X | X | X | X | X | X |

6-Shelf Refrigerator

| Shelf | T1 | T2 | T3 | T4 | T5 | T6 | T7 | T8 | T9 | T10 |
|---|---|---|---|---|---|---|---|---|---|---|
| 1 | A | A | A | A | X | X | X | A | A | A |
| 2 | A | A | A | X | A | A | A | X | X | X |
| 3 | A | A | X | X | X | A | A | A | X | A |
| 4 | A | X | X | X | X | X | A | X | A | A |
| 5 | X | X | X | X | X | X | X | X | X | X |
| 6 | X | X | X | X | X | X | X | X | X | X |

7-Shelf Refrigerator

| Shelf | T1 | T2 | T3 | T4 | T5 | T6 | T7 | T8 | T9 | T10 | T11 | T12 | T13 | T14 |
|---|---|---|---|---|---|---|---|---|---|---|---|---|---|---|
| 1 | A | A | A | A | A | X | X | X | X | A | A | A | A | A |
| 2 | A | A | A | A | X | A | A | A | A | X | X | X | X | X |
| 3 | A | A | A | X | X | X | A | A | A | A | X | A | A | A |
| 4 | A | A | X | X | X | X | X | A | A | X | A | A | X | A |
| 5 | A | X | X | X | X | X | X | X | A | X | X | X | A | A |
| 6 | X | X | X | X | X | X | X | X | X | X | X | X | X | X |
| 7 | X | X | X | X | X | X | X | X | X | X | X | X | X | X |

It will of course be apparent that the arrangements as set out in these tables are not exhaustive and other arrangements may be preferable depending upon the type of refrigerator, they type of goods being displayed and other factors. Many permutations of shelves with and without aerofoils are possible.

Evidently one or more aerofoils might be attached to lower shelves of a refrigerator, but such aerofoils might provide a negligible increase in energy saving in comparison to attaching aerofoils to shelves in the upper half of the open front of a refrigerator.

It is believed that, when a plurality of shelves have respective aerofoils attached to them, a biasing of the location of shelves with aerofoils towards the upper air egress is preferable.

Aerofoils may of course be retrofit to refrigerators or alternatively refrigerators might be constructed with one or more aerofoils.

Many variations are possible without departing from the scope of the present invention as described in the appended claims.

What is claimed is:

1. An apparatus, comprising:

a housing defining an interior configured to be refrigerated;

an upper air egress configured to produce air to form an air curtain that separates the interior of the housing from an exterior of the housing;

a plurality of shelves disposed in the interior of the housing, no shelves other than the plurality of shelves being disposed in the interior of the housing; and a plurality of airfoils, each airfoil from the plurality of airfoils coupled to a shelf from the plurality of shelves, a number of shelves in the plurality of shelves exceeding a number of airfoils from the plurality of airfoils, a greater number of airfoils from the plurality of airfoils being disposed in an upper half of the housing than a lower half of the housing, no airfoils other than the plurality of airfoils coupled to a shelf from the plurality of shelves.

2. The apparatus of claim 1, wherein a number of airfoils in the plurality of airfoils is six fewer than a number of shelves in the plurality of shelves.

3. The apparatus of claim 1, wherein a number of airfoils in the plurality of airfoils is five fewer than a number of shelves in the plurality of shelves.

4. The apparatus of claim 1, wherein a number of airfoils in the plurality of airfoils is four fewer than a number of shelves in the plurality of shelves.

5. The apparatus of claim 1, wherein a number of airfoils in the plurality of airfoils is three fewer than a number of shelves in the plurality of shelves.

6. The apparatus of claim 1, wherein a number of airfoils in the plurality of airfoils is two fewer than a number of shelves in the plurality of shelves.

7. The apparatus of claim 1, wherein a number of airfoils in the plurality of airfoils is one fewer than a number of shelves in the plurality of shelves.

8. The apparatus of claim 1, wherein the plurality of shelves includes at least three shelves, at least a lowest shelf from the plurality of shelves not having an airfoil from the plurality of airfoils coupled thereto.

9. The apparatus of claim 1, wherein the plurality of shelves includes at least four shelves, at least a lowest shelf from the plurality of shelves not having an airfoil from the plurality of airfoils coupled thereto.

10. The apparatus of claim 1, wherein the plurality of shelves includes at least four shelves, at least a lowest two shelves from the plurality of shelves not having airfoils from the plurality of airfoils coupled thereto.

11. The apparatus of claim 1, wherein the plurality of shelves includes at least five shelves, at least a lowest three shelves from the plurality of shelves not having airfoils from the plurality of airfoils coupled thereto.

12. An apparatus, comprising:

a housing defining an interior configured to be refrigerated;

an upper air egress configured to produce air to form an air curtain that separates the interior of the housing from an exterior of the housing;

at least three shelves disposed in the interior of the housing, no shelves other than the at least three shelves being disposed in the interior of the housing; and a plurality of airfoils, each airfoil from the plurality of airfoils coupled to a shelf from the at least three shelves, no airfoil from the plurality of airfoils coupled to a bottom-most shelf from the at least three shelves, no airfoils other than the plurality of airfoils coupled to a shelf from the at least three shelves.

13. The apparatus of claim 12, wherein a greater number of airfoils from the plurality of airfoils are disposed in an upper half of the housing than a lower half of the housing.

14. The apparatus of claim 12, wherein:

the at least three shelves includes at least four shelves; and no airfoil from the plurality of airfoils is coupled to the two bottom-most shelves from the at least four shelves.

15. The apparatus of claim 12, wherein:

the at least three shelves includes at least six shelves; and the plurality of airfoils includes at least five airfoils.

16. The apparatus of claim 12, wherein a number of airfoils from the plurality of airfoils is fewer than a number of shelves from the at least three shelves.

17. The apparatus of claim 12, wherein a number of airfoils in the plurality of airfoils is three fewer than a number of shelves in the at least three shelves.

18. The apparatus of claim 12, wherein a number of airfoils in the plurality of airfoils is two fewer than a number of shelves in the at least three shelves.

19. The apparatus of claim 12, wherein a number of airfoils in the plurality of airfoils is one fewer than a number of shelves in the at least three shelves.

20. The apparatus of claim 12, wherein each shelf from the at least three shelves disposed in an upper half of the interior of the housing has an airfoil from the plurality of airfoils coupled thereto.

* * * * *